United States Patent [19]

Sutton

[11] Patent Number: 4,691,915

[45] Date of Patent: Sep. 8, 1987

[54] VERSATILE FITNESS KIT

[76] Inventor: Bernard Sutton, 128 Lafayette Ave., Brooklyn, N.Y. 11238

[21] Appl. No.: 814,107

[22] Filed: Dec. 27, 1985

[51] Int. Cl.[4] ..... A63B 11/08

[52] U.S. Cl. ..... 272/68; 272/122; 272/137

[58] Field of Search ..... 272/67, 68, 122, 123, 272/135-137, 141

[56] References Cited

U.S. PATENT DOCUMENTS

| | | | |
|---|---|---|---|
| 1,026,215 | 5/1912 | Korth | 272/68 |
| 2,263,135 | 11/1941 | Johnson | 272/68 |
| 2,529,347 | 11/1950 | Mohler et al. | 272/137 |
| 2,633,358 | 3/1953 | Wright | 272/68 |
| 2,814,491 | 11/1957 | Proctor | 272/122 |
| 4,021,040 | 5/1977 | Inoue | 277/68 |
| 4,192,500 | 3/1980 | Crow et al. | 272/68 |
| 4,566,690 | 1/1986 | Schook | 272/122 |

*Primary Examiner*—Richard J. Apley
*Assistant Examiner*—J. Welsh
*Attorney, Agent, or Firm*—Charles E. Baxley

[57] ABSTRACT

A versatile fitness kit wherein apparatus is provided which is particularly suitable of aerobic, jogging, race-walking, running and walking type exercises. The fitness apparatus comprises a U-shaped member which is capable of selectively resisting pressure which would be applied through the manipulation of the hand through grippers that are movably mounted on the U-shaped device. There is also provided an adjustable member which is mounted on the U-shaped device to adjust the amount of pressure to that desired during the exercise period.

4 Claims, 8 Drawing Figures

10
30
60
32
60'
42
40
85
80
82
81
83
84
44
70'
5
50
50'
52'
52
54
54'
6A
90
92
16
17
17'
22
18
12
14
70
91

VERSATILE FITNESS KIT

BACKGROUND OF THE INVENTION

This invention relates to a versatile fitness kit including apparatus which is particularly beneficial to those who are interested in improving the muscular development of the upper body, hips, lower limbs and more specifically for the arms and shoulders. The versatile fitness apparatus is also particularly helpful in improving the aerobic capacity of the user.

Weight devices such as dumbells have been used previously to condition joggers, runners, and for body development and muscle coordination, as have hand grippers in a more specialized and related use. Typical of such dumbells is the device shown in U.S. Pat. No. 1,577,077.

It will be obvious that hand grippers which are coil tempered to meet the needs of the various training levels by providing increased strenuousness for the exercise through a number of different means have limitations. One improvement of the present invention provides or eliminates the necessity of buying more than one hand gripper to increase the strenuousness of the exercise, as the invention through its adjustability accomplishes this result. The versatile fitness apparatus also eliminates the necessity of buying devices such as aerobic hand weights and dumbells because the versatile gripper members, as will be detailed hereinafter, are detachably connectable to provide this aerobic fitness function.

BRIEF DESCRIPTION OF INVENTION

One aspect of the present invention is to provide a versatile fitness apparatus which consists of a three-in-one device to function as an aerobic hand gripper and therefore eliminate the need to utilize other less versatile hand grippers.

To demonstrate the versatility of my invention and while in the form of a hand gripper, a finger gripping member is slidably mounted on one leg of a U-shaped spring loaded device and a thumb gripping member is mounted on the other leg of said U-shaped device. In this fashion, manipulation of the hand gripper is possible as will be obvious.

Secondly, detachment of the finger gripping member from the leg of the U-shaped device and detachment of the thumb gripping member of the U-shaped device and connection of these gripping members as is shown in FIG. 1, provides a versatile aerobic gripper for a different but necessary fitness function.

Thirdly, a weight, whose measure may be preselected, is shown as detachably connected to the aerobic gripper to make the exercise more or less strenuous as desired, and while one weight is preferred it is within the teachings of the present invention to use plural weights. In the preferred embodiment the weight is either square or octagonally shaped with a flat bottom to faciliate storage when the versatile fitness apparatus is not in use.

The invention disclosed also provides a convenient way to carry the fitness apparatus to provide further versatility, that is, connectors are incorporated into the U-shaped devices so that they can be conveniently joined to a belt with similar connectors to those in the U-shaped devices. The belt then can be carried over the shoulder to free the hands for other uses. In this fashion a versatile multipurpose fitness apparatus can be adjusted to accommodate different uses. In the preferred form the belt is made to size and is padded on the inside to provide a high degree of comfort when worn around the waist. There is also included a localized padded area on the outside of the belt to add comfort to the shoulder area when it serves as a means for carrying the versatile fitness apparatus.

To facilitate the hand gripper function a calibration scale is included on the outside leg of the U bar to permit selection of the strenuousness of the exercise during this function.

Also reflectors may be provided on the belt and/or the finger and thumb gripping portions to provide greater visibility at night.

It also will be realized by one skilled in the art from the description that follows that the belt versatile and fitness apparatus which is preferably sold in kit form, will easily conform to the known methods of manufacture and will be uncomplicated in construction and therefore commercially feasible.

These and other features, objects and advantages will be further understood and appreciated by those skilled in the art by reference to the following description, claims and drawings.

DETAILED DESCRIPTION OF THE INVENTION

The invention relates to a versatile fitness apparatus kit which provides a totally new convertible product which after simple adjustment of its parts is intended for use in aerobics, jogging, racewalking, running and walking.

As will be described in detail hereinafter, a belt with suitable padding is also provided which facilitates the carrying of the versatile fitness apparatus so as to free up the hands for other uses when the exercise function is inactive.

While the objectives, purposes and advantages of the invention have been set out generally, other objects will be more clearly understood from the following description and the accompanying drawings in which.

Figures 4, 5, 6, 6A:
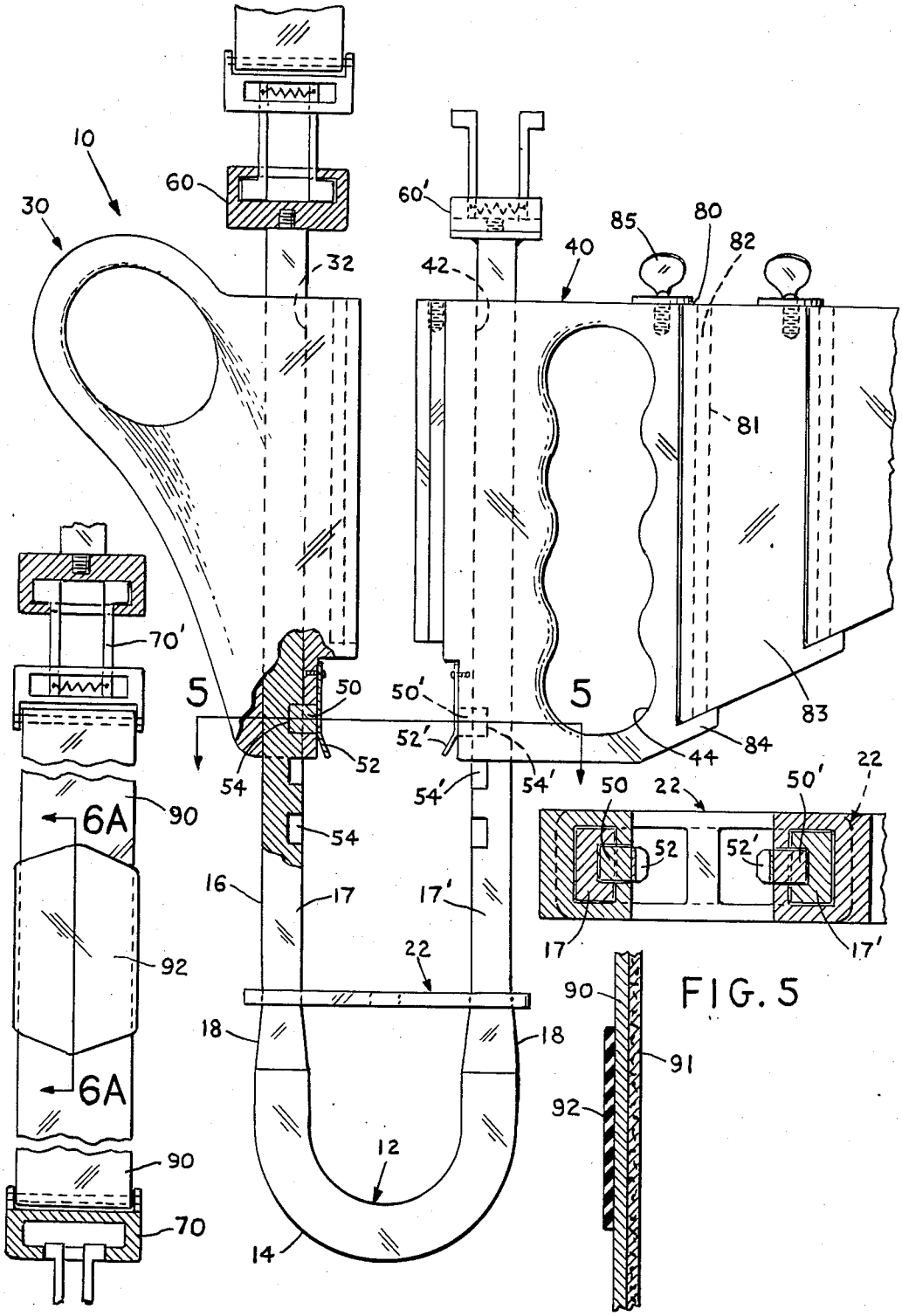
FIG. 4 is a side view showing assembly of the fitness apparatus in the form wherein it is shown as a hand gripper.
FIG. 5 is a sectional view taken on lines 5—5 of FIG. 4.
FIG. 6 is a view of the shoulder and waist belt showing the connecting members and the padding to facilitate carrying of the versatile fitness apparatus shown in FIG. 4.
FIG. 6A is a sectional view taken on lines 6A—6A to show the padding on the belt of FIG. 6.

Referring to the drawings, there is shown in FIG. 4 a view of the versatile fitness apparatus generally designated 10 and assembled to form a jogging gripper comprising a U-shaped device 12 which has, at the periphery, an oversized U portion 14 when compared with the periphery 16 of the leg 17. Stated differently the U-portion 14 is enlarged and slims down at 18 to a smaller dimension for each of the legs 17 and 17'. In this fashion a degree of adjustability of the resistance of the U-shaped device is provided for increased resistance when the fitness apparatus 10 serves the function of a hand gripper. The U-shaped device takes the form of a rectangle or channel as shown in FIG. 5 and a restraining member 22 is mounted on the legs 17 and 17'. The restraining member functions to hold the legs 17 and 17' in optimum position so that the hand gripper function can be performed. Without the restrainer 22, the U-shaped device 12 would open due to the U-shaped device being spring loaded to provide a desired resistance during the hand gripping function.

Figure 3:
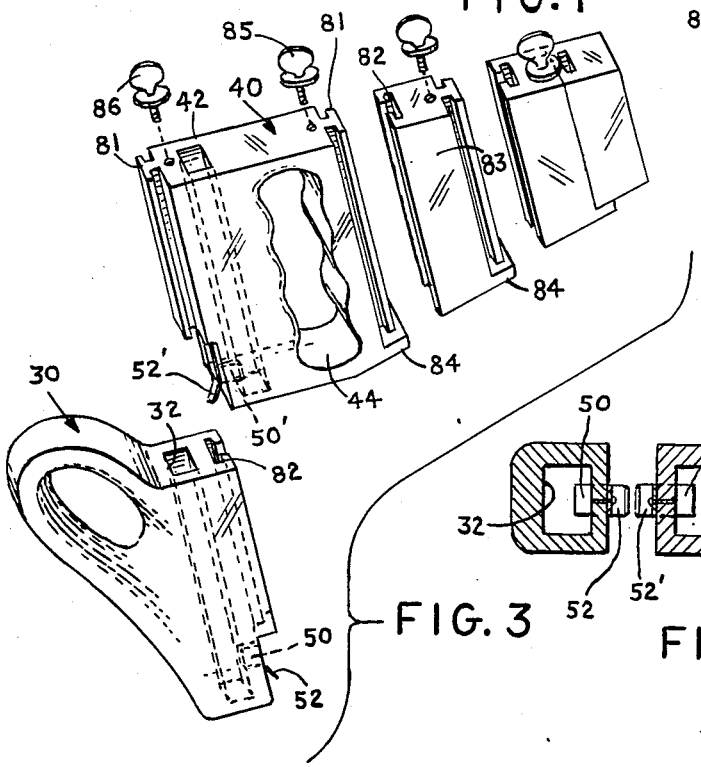
FIG. 3 is an exploded perspective view of the aerobic gripper of FIG. 1.
Figure 2B:
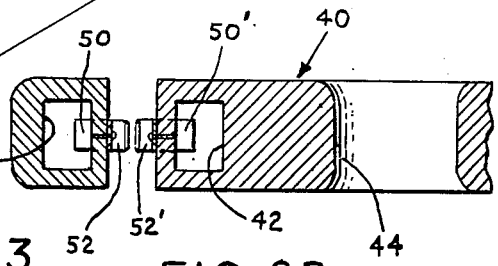
FIG. 2B is a cross section taken on the section line 2B—2B of FIG. 1.

A thumb gripping unit or portion 30 is slidably mounted on the U-shaped leg 17. This is accomplished by providing a rectangular opening 32 throughout the length of the thumb gripping unit as is best seen in FIG. 3. Similarly a finger gripping unit or portion 40 is mounted on the leg 17' in exactly the same fashion as was described hereinabove for the thumb gripping unit 30. That is, there is also a rectangular opening 42 in the finger gripping unit 40 which is slidably mounted on the leg 17'.

Adjustability to provide for a more strenuous or less strenuous hand gripper exercise is accomplished by arranging for the thumb gripping unit 30 and the finger supporting member 40 to be slidably arranged on the legs 17 and 17' of the fitness apparatus to provide a more severe or less severe resistance as is desired by the user. In this connection if the units 30 and 40 are moved in the direction of the U 14, there will be a more strenuous exercise and if the gripping members 30 and 40 are moved downwardly towards the ends of the legs 17 and 17', there will be a less strenuous exercise.

The specific provisions for the adjustability of the finger and thumb gripping units comprise the combination of the slidability of the finger and thumb grippers along the legs 17 and 17' with the capability of fixing these grippers by means of stops 50 and 50' on the finger gripper 40 and thumb gripper 30. These stops are connected to springs 52 and 52' respectively and said stops may be dislodged from slots 54 and 54' by finger action to permit movement to other slot locations on the legs 17 and 17'. In this manner the desired adjustability is provided.

Attached to each of the legs 17 and 17' respectively are the connecting members 60 and 60'. Note that these connecting members are threaded to the ends of the legs 17 and 17' so that they may be disconnected if desired and they also serve as stops for the thumb gripper 30 and the finger gripper 40 to facilitate carrying these devices when connected to a belt 90 as will be described hereinafter. Any male/female connector well known in the art is suitable for this purpose.

To carry the versatile fitness apparatus, the belt 90 having complimentary connecting members as is shown in FIG. 6 and designated 70 and 70' to those on the versatile jogging grippers are utilized. As will be obvious two of the fitness devices 10 would be used normally for fitness purposes and with the provision of identical connecting members on the end of the second jogging gripper opposite or crisscross connection of the connecting members to identical connectors 70 and 70' formed on the ends of the belt provides for a very simple and efficient manner to carry the apparatus when they are not in use. This permits the utilization of the hands for other purposes.

Preferably the belt 90 includes a full length padded interior 91 shown in FIG. 6A. On the opposite side of the belt there is located a localized padded portion 92 to make shoulder carrying of the apparatus more comfortable.

At the top of the finger gripping portion 40 and the base of the thumb gripping portion 30, there is provided a joining arrangement 80 which comprises a key 81 and a keyway 82. A similar joining or connection arrangement is provided for the add on weight 83.

Additionally an angled end 84 at the bottom end of the finger gripper portion serves to hold the add on weight 83 in cooperation with a wing nut 85 which functions to provide and serves to permit detachable connection of the add on weight 83 to the bottom of the fingers gripping portion 40. Detachability is accomplished in combination with the key and the keyway and wing nut 85.

Additional weights may be added as is shown in FIG. 3. Those added weights serve the purpose of providing a more strenuous exercise and may be connected to the weight 83 as is shown in FIG. 3 in the same fashion as described above for connection to the base or joining arrangement 80.

As was previously described generally the thumb gripping member 30 and finger gripping member 40 may be disconnected by sliding each unit off the legs 17 and 17'. This is accomplished simply by disconnecting the threaded connecting members 60 and 60' and as is shown in FIG. 3. The thumb gripping member 30 and finger supporting member 40 may also be connected in a key and keyway arrangement and maintained in position by a wing nut 86 which is also shown in FIG. 3 of the drawings. In this way an aerobic type of gripper is fashioned and can be utilized for aerobic exercise purposes. This is accomplished by detachable connection of the finger and thumb members as shown in FIG. 1 through a key and keyway arrangement in cooperation with the wing nut 86.

Figure 1:
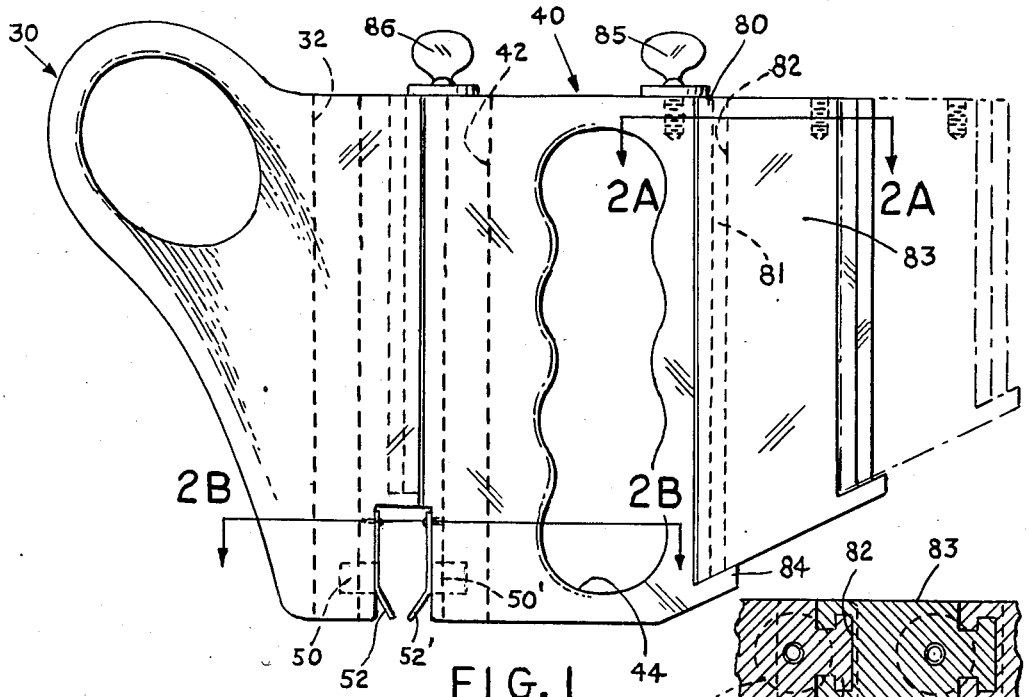
FIG. 1 is an enlarged side view of the versatile aerobic gripper form of the fitness device of the instant invention which may be used as will be described for the development of the aerobic qualities of the user.
Figure 2A:
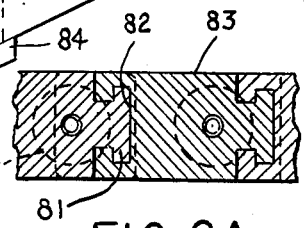
FIG. 2A is a cross section taken on the section line 2A—2A of FIG. 1.

As will be seen in FIG. 1 the finger gripping portion 40 is provided with fingers supporting grooves designated 44 to accommodate the fingers comfortably during use thereof in either the hand gripper or jogging functions.

Additional weights as is shown in FIG. 3 may be added to provide a more vigorus exercise to achieve a greater aerobic benefit.

The specification incorporates preferred embodiments of the invention, however, it will be understood that the invention may be otherwise embodied within the scope of the following claims.

I claim:

1. A versatile fitness kit including a U-shaped spring resistance device having elongated legs, a weighted thumb gripping means, a weighted finger gripping means, said weighted thumb gripping means including a joining means, said weighted finger gripping means including another joining means, said weighted thumb gripping means detatchably mounted on one of said elongated legs, said weighted finger gripping means detachably mounted on the other of said elongated legs, whereby the fingers of the hand engage the finger gripping means and the thumb engages the thumb gripping means and said hand may be manipulated to squeeze said U-shaped spring resistance device, and said weighted thumb gripping means and said finger gripping means when detached may be interconnected to each other by each said joining means to form a hand weight.

2. The versatile fitness kit of claim 1 wherein the U-shaped spring resistance device comprises a U-portion at one end and a first and second leg at the other end, the U-shaped portion having a greater cross-sectional size than the first and second legs, said versatile fitness kit also including a restraining member, said restraining member mounted on said U-shaped spring resistance device in proximate relation to said U-shaped portion to hold said first and second legs spaced from one another.

3. The versatile fitness kit of claim 1 wherein plural stop means are selectively formed in one of said elongated legs, and second plural stop means are selectively formed in the other of said elongated legs, a first means mounted on said thumb gripping means to engage with one of said stop means on one of said elongated legs, a second means mounted on said finger gripping means to engage with one of said stop means on the other of said elongated legs whereby a predetermined adjustment of said versatile fitness kit is possible by detachaly connecting said thumb and finger gripping means respectively to a stop means on one of said elongated legs and to a stop means on the other of said elongated legs at selected locations on said elongated legs to increase or decrease the strenuousness of the exercise.

4. The versatile fitness kit of claim 2 wherein plural stop means are selectively formed in one of said elongated legs, and second plural stop means are selectively formed in the other of said elongated legs, a first means mounted on said thumb gripping means to engage with one of said stop means on one of said elongated legs, a second means mounted on said finger gripping means to engage with one of said stop means on the other of said elongated legs whereby a predetermined adjustment of said versatile fitness kit is possible by detachably connecting said thumb and finger gripping means respectively to a stop means on one of said elongated legs and to a stop means on other of said elongated legs at selected locations on said legs to increase or decrease the strenuousness of the exercise.

* * * * *